US007121751B2

(12) United States Patent
Harada et al.

(10) Patent No.: US 7,121,751 B2
(45) Date of Patent: Oct. 17, 2006

(54) PLACING PRINTING ELEMENTS AND MARK SENSOR AT PROPER POSITIONS WITH RESPECT TO THE CUTTER MEMBER

(75) Inventors: Hironori Harada, Chiryu (JP); Yoshihito Nonomura, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/519,503

(22) PCT Filed: Jun. 24, 2003

(86) PCT No.: PCT/JP03/08009

§ 371 (c)(1),
(2), (4) Date: Aug. 29, 2005

(87) PCT Pub. No.: WO04/000564

PCT Pub. Date: Dec. 31, 2003

(65) Prior Publication Data

US 2006/0013634 A1 Jan. 19, 2006

(30) Foreign Application Priority Data

Jun. 25, 2002 (JP) ..... 2002-183746

(51) Int. Cl.
*B41J 11/26* (2006.01)

(52) U.S. Cl. ..... 400/615.2; 400/621

(58) Field of Classification Search ..... 400/615.2, 400/621; 101/416.1; 347/217, 104; 156/361; 355/29, 28; 83/76.5; 386/63
See application file for complete search history.

(56) References Cited

U.S. PATENT DOCUMENTS

| | | | | |
|---|---|---|---|---|
| 3,700,908 | A * | 10/1972 | Devaney, Jr. | 250/559.44 |
| 4,140,390 | A * | 2/1979 | Schultheis et al. | 355/29 |
| 4,429,988 | A * | 2/1984 | Okabe | 355/28 |
| 5,706,078 | A * | 1/1998 | Cesa et al. | 355/72 |
| 6,588,740 | B1 * | 7/2003 | Brugger et al. | 271/10.03 |
| 6,923,534 | B1 * | 8/2005 | Sai | 347/104 |

FOREIGN PATENT DOCUMENTS

| | | | |
|---|---|---|---|
| JP | 362255353 | A * | 11/1987 |
| JP | 402046451 | A * | 8/1988 |
| JP | A 7-251539 | | 10/1995 |
| JP | A 9-174899 | | 7/1997 |
| JP | A 11-100156 | | 4/1999 |
| JP | A 11-263055 | | 9/1999 |
| JP | A 2000-168181 | | 6/2000 |
| JP | A 2002-103286 | | 4/2002 |

* cited by examiner

*Primary Examiner*—Daniel J. Colilla
*Assistant Examiner*—Wasseem H. Hamdan
(74) *Attorney, Agent, or Firm*—Oliff & Berridge, PLC

(57) ABSTRACT

A tape printer, wherein when a label tape (36) is fed to a tape cutting position after the label (39) of the label tape (36) is printed out, the heating elements (R1 to Rn) of a thermal head (9) are disposed so as to be opposed to the position of a next printed label (39) slightly on the upstream side of a label head position on the downstream side of thereof in the feeding direction and to be opposed to the position of the next printed label (39) on the downstream side of the printing start position thereof (so that a<b can be established in FIG. 7), and a mark detection sensor (12)is disposed on the upstream side of the heating elements (R1 to Rn) so as to be opposed to the position slightly on the downstream side of the position opposed to a position detection mark (39B) (so that c<e can be established in FIG. 7).

8 Claims, 8 Drawing Sheets

(A)

(B)

PLACING PRINTING ELEMENTS AND MARK SENSOR AT PROPER POSITIONS WITH RESPECT TO THE CUTTER MEMBER

TECHNICAL FIELD

The present invention relates to a tape printing device configured to have the function of printing letters, etc. on a long tape while feeding the tape and thereafter cutting off the printed tape by a cutter member, and a tape cassette which is detachably loaded in the tape printing device. In particular, the present invention relates to the composition of a tape printing device and a tape cassette for using a label tape in which a plurality of labels are temporarily stuck on the front side of a long strippable sheet being aligned along the length of the strippable sheet and position indication marks for the detection of the positions of the labels are formed at prescribed positions on the back side of the strippable sheet.

BACKGROUND OF THE INVENTION

Tape printing devices for printing letters, etc. on a label tape (having a plurality of labels temporarily stuck on the front side of a long strippable sheet being aligned along its length) are well known today. In regard to such tape printing devices, a variety of configurations, for detecting marks (position indication marks) formed on the back side of the label tape by use of a mark sensor and carrying out feeding control of the label tape based on the detection of the position indication marks, have been proposed (e.g. Japanese Patent Provisional Publication No. 2000-168181).

DISCLOSURE OF THE INVENTION

However, in the aforementioned conventional printing devices capable of printing on label tapes, if the mark sensor is placed far from a thermal head, restarting the tape printing device after shutting off the power might result in feeding the first label without printing and starting the printing from the second label in cases where the space (interval) between adjacent labels is short.

The present invention has been made for resolving the above problem and it is therefore the primary object of the present invention to provide a tape printing device capable of reliably printing letters, etc. up to the last label of a label tape (in which position indication marks for the detection of the positions of the labels are formed at prescribed positions on the back side of the strippable sheet) as well as surely printing from the first label even on the restart of the tape printing device, by placing printing elements and the mark sensor at proper positions with respect to the cutter member.

Another object of the present invention is to provide a tape cassette to be detachably loaded in the tape printing device, including a tape spool around which a label tape is rolled up.

To achieve the above objects, in accordance with an aspect of the present invention, in a tape printing device comprising tape feed means for feeding a long tape, printing means for printing on the tape, and a cutter member being placed on the downstream side of the printing means for cutting the tape, the tape is formed of a label tape in which a plurality of labels are temporarily stuck on a front side of a long strippable sheet being aligned along the length of the strippable sheet. The tape printing device further comprises a mark sensor which detects position indication marks formed at prescribed positions (in a tape feeding direction) on a back side of the strippable sheet opposed to (i.e. facing via the strippable sheet) corresponding labels respectively and control means which controls the tape feed means based on an output signal outputted by the mark sensor. The printing means includes a plurality of printing elements. The printing elements are situated on the downstream side of a print start position of a next label (which will be printed on next) at a point when the label tape after the printing on a label has been fed to a tape cutting position to be cut by the cutter member. The mark sensor is situated on the downstream side of a position indication mark opposed to the next label and on the upstream side of the printing elements at the point when the label tape after the printing on a label has been fed to the tape cutting position to be cut by the cutter member.

According to the tape printing device configured as above, letters, etc. are printed on each label by the printing means while the label tape (in which a plurality of labels are temporarily stuck on a front side of a long strippable sheet being aligned along the length of the strippable sheet) is fed by the tape feed means. The position indication marks are formed at prescribed positions in the tape feeding direction on the back side of the strippable sheet of the label tape opposed to corresponding labels respectively. The tape feed means is controlled based on the output signal outputted by the mark sensor detecting the position indication marks. The cutter member for cutting the tape is placed on the downstream side of the printing means. At the point when the label tape after the printing on a label has been fed to a tape cutting position to be cut by the cutter member, the printing elements of the printing means are situated on the downstream side of a print start position of a next label which will be printed on next, and the mark sensor is situated on the downstream side of a position indication mark opposed to the next label and on the upstream side of the printing elements.

To achieve the aforementioned objects, in accordance with another aspect of the present invention, there is provided a tape printing device for printing on a long tape. The long tape is a label tape including a plurality of labels temporarily stuck on a front side of a long strippable sheet being aligned along the length of the strippable sheet and a plurality of position indication marks formed on a back side of the strippable sheet along its length to be opposed to (i.e. to face via the strippable sheet) corresponding labels respectively for enabling detection of each label on the front side. Each position indication mark corresponding to each label on the front side is formed at a position on the back side of the strippable sheet that corresponds to a prescribed position on the corresponding label in a tape feeding direction. The tape printing device comprises a tape feed unit for feeding the long tape, a printing unit for printing on the tape, a cutter member being placed on the downstream side of the printing unit in the tape feeding direction for cutting the tape, a mark sensor which successively detects the position indication marks formed on the long tape when the tape is fed, and a control unit which carries out printing by controlling the printing unit while controlling the tape feed unit based on an output signal outputted by the mark sensor. The printing unit is placed so that the printing unit, at a point when the label tape after the printing on a label has been fed by the control unit to a tape cutting position to be cut by the cutter member, will be situated on the downstream side in the feeding direction of a print start position of a label nearest to the tape cutting position. The mark sensor is placed so that the mark sensor, at the point when the label tape after the printing on a label has been fed by the control unit to the tape cutting position to be cut by the cutter member, will be situated on the downstream side in the feeding direction of a position indication mark corresponding to the label nearest to the tape cutting position and on the upstream side in the feeding direction of the printing unit.

According to the tape printing device configured as above, letters, etc. are printed on each label by the printing unit while the label tape (in which a plurality of labels are temporarily stuck on a front side of a long strippable sheet being aligned along the length of the strippable sheet) is fed by the tape feed unit. The position indication marks are formed at positions on the back side of the strippable sheet that correspond to prescribed positions on the corresponding labels in the tape feeding direction. The tape feed unit is controlled based on the output signal outputted by the mark sensor detecting the position indication marks. The cutter member for cutting the tape is placed on the downstream side of the printing unit. The printing unit is situated on the downstream side of the print start position of the next label which will be printed on next (the label nearest to the tape cutting position) at the point when the label tape after the printing on a label has been fed to the tape cutting position to be cut by the cutter member. The mark sensor is situated on the downstream side of the position indication mark corresponding to the next label and on the upstream side of the printing unit at the point when the label tape after the printing on a label has been fed to the tape cutting position of the cutter member.

Figure 1:
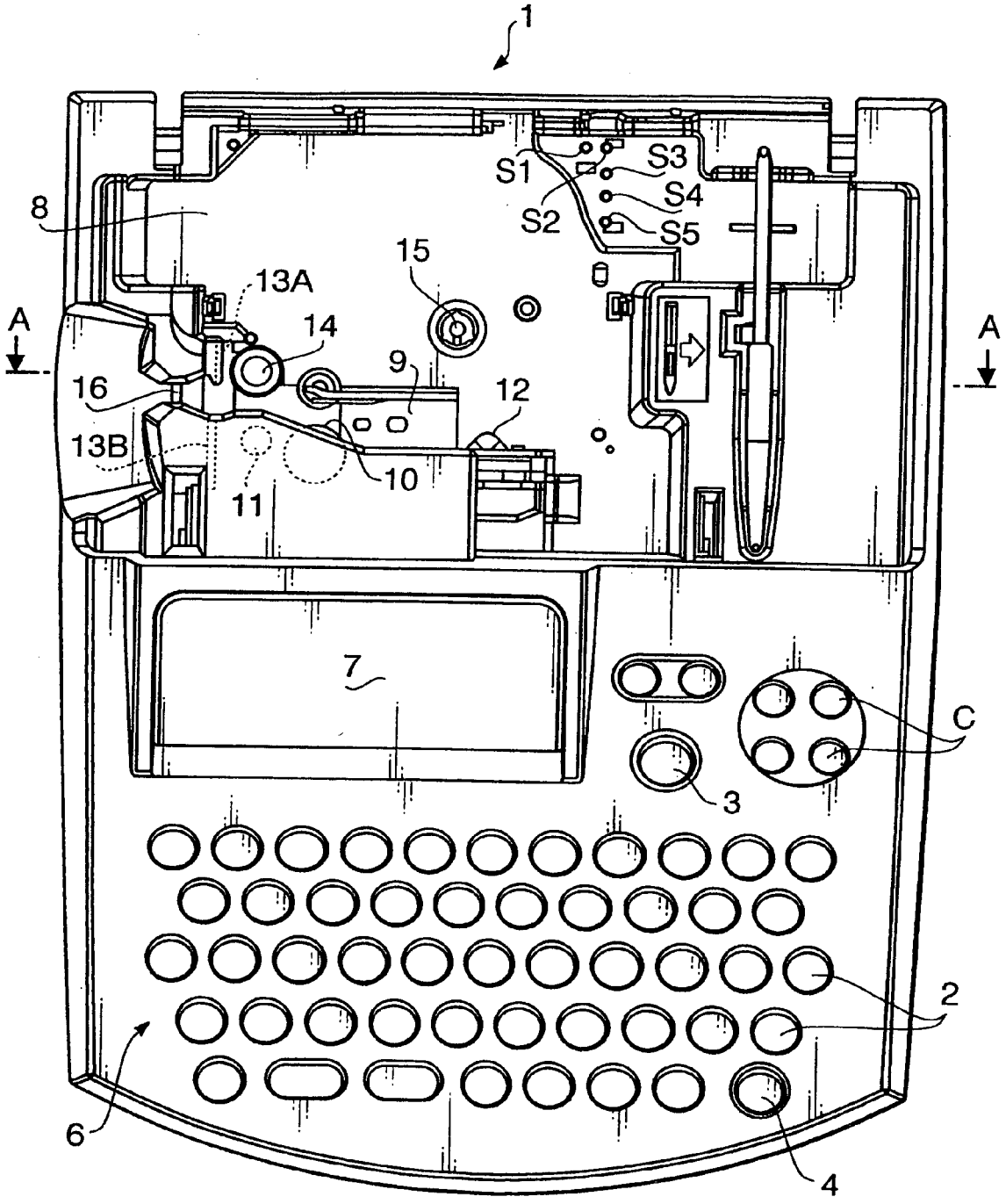
FIG. 1 is a schematic top view of a tape printing device in accordance with an embodiment of the present invention with its storage cover removed.

BEST MODE FOR CARRYING OUT THE INVENTION,

Referring now to the drawings, a description will be given in detail of an embodiment of a tape printing device and a tape cassette in accordance with the present invention. First, a brief outline of the composition of the tape printing device of the embodiment will be described referring to FIGS. 1 through 4.

Figure 2:
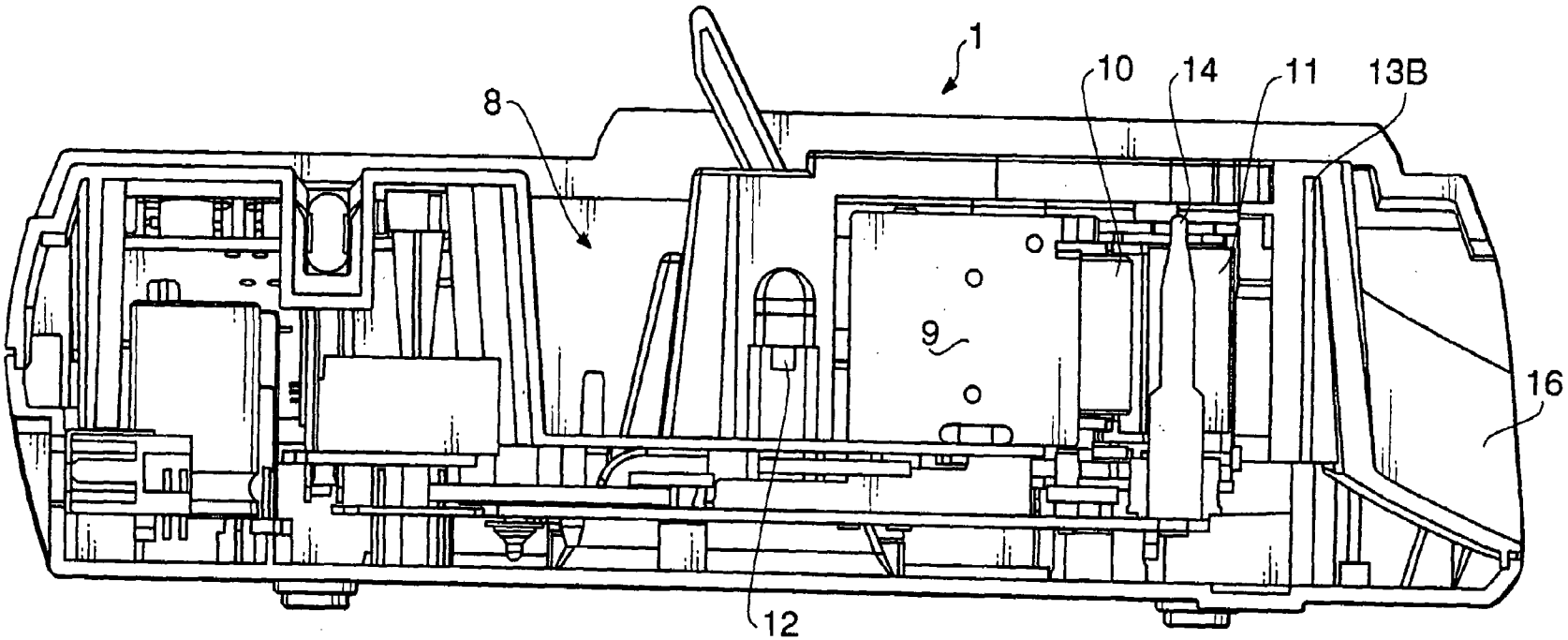
FIG. 2 is a cross-sectional view of the tape printing device of the embodiment taken along the line A-A shown in FIG. 1.
Figure 3:
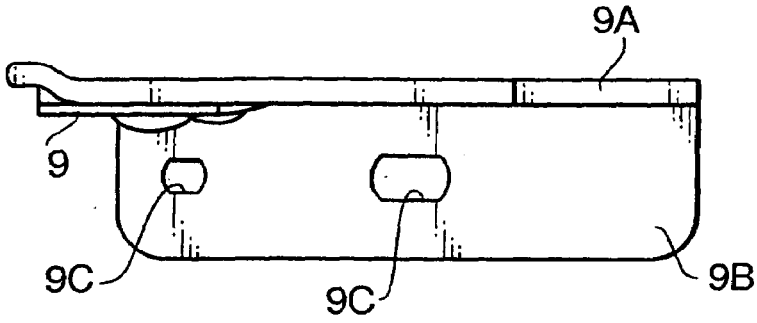
FIG. 3 is a schematic diagram showing a brief outline of the composition of a thermal head of the tape printing device of the embodiment, in which (A) is a plan view and (B) is a front view.
Figure 3:
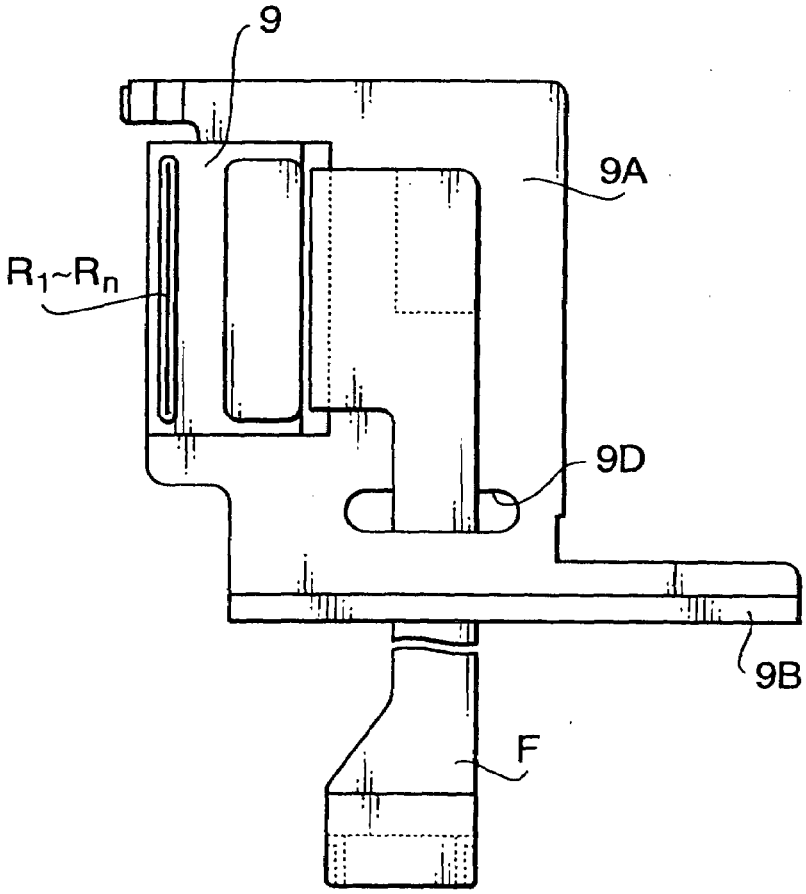
Figure 4:
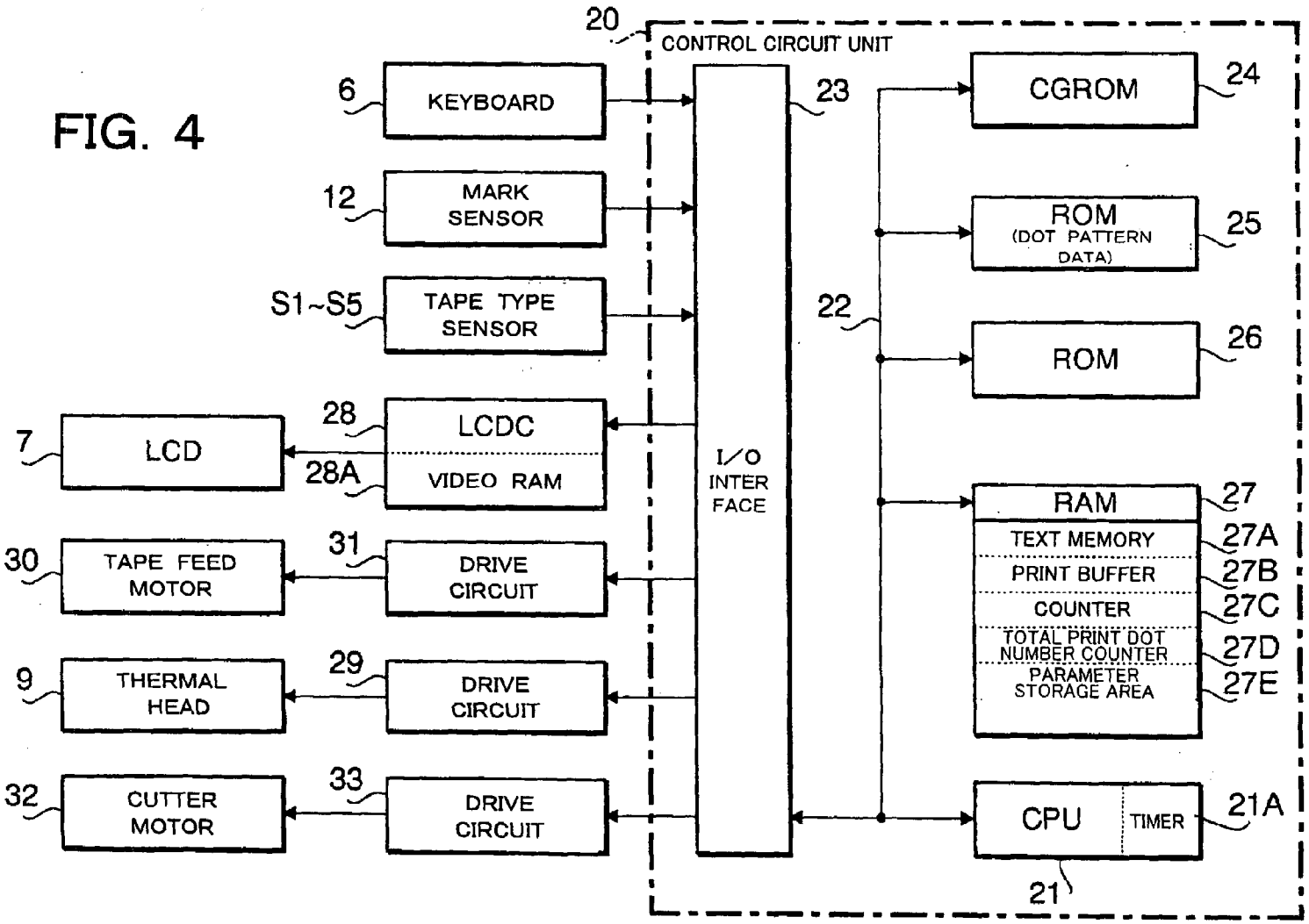
FIG. 4 is a block diagram showing the composition of a control system of the tape printing device of the embodiment.

FIG. 1 is a schematic top view of the tape printing device in accordance with the embodiment with its storage cover removed. FIG. 2 is a cross-sectional view of the tape printing device of the embodiment taken along the line A—A shown in FIG. 1. FIG. 3 is a schematic diagram showing a brief outline of the composition of a thermal head of the tape printing device of the embodiment, in which (A) is a plan view and (B) is a front view. FIG. 4 is a block diagram showing the composition of a control system of the tape printing device of the embodiment.

As shown in FIGS. 1 and 2, the tape printing device 1 includes a keyboard 6 on which various key boards are arranged and a cassette storage part 8 for storing a tape cassette 35 which will be explained later (see FIG. 5). The cassette storage part 8 is covered with an unshown storage cover. On the keyboard 6 are arranged a character input keys 2 used for generating document data (text), a print key 3 used for ordering the printing of the text, a return key 4 used for ordering a line feed, various processes, selections, etc., cursor keys C, and so forth. By operating the cursor keys C, a cursor can be moved vertically and horizontally on a liquid crystal display 7 (hereinafter referred to as an "LCD 7") which displays characters such as letters across a plurality of lines.

Under the keyboard 6, an unshown control circuit board, on which a control circuit unit 20 which will be explained later is formed, is placed. On the left side wall of the cassette storage part 8, a label outlet hole 16 for ejecting the tape after being printed on (printed tape) is formed. On the right side wall of the cassette storage part 8, an adapter slot, to which a power adapter is attached, is formed.

In the cassette storage part 8, a thermal head 9 which will be explained later (see FIG. 3), a platen roller 10 facing the thermal head 9, a tape feed roller 11 on the downstream side of the platen roller 10, and a tape drive roller spindle 14 facing the tape feed roller 11 are arranged. Also arranged in the cassette storage part 8 are a ribbon roll-up spindle 15 for feeding an ink ribbon stored in the tape cassette 35, etc. The ribbon roll-up spindle 15 is driven and rotated by a tape feed motor 30 (implemented by a stepping motor, for example) which will be explained later (see FIG. 4) via an unshown proper driving mechanism. The ribbon roll-up spindle 15 is inserted into an unshown ink ribbon roll-up reel (which rolls up the ink ribbon after printing) and thereby drives and rotates the ink ribbon roll-up reel in sync with the printing speed. The tape drive roller spindle 14 is driven and rotated by the tape feed motor 30 via an unshown proper transmission mechanism and thereby drives and rotates a tape drive roller 53 which will be explained later (see FIG. 5).

At a position facing a mark detection opening 42 (explained later, see FIGS. 5 and 6) on a side face of the tape cassette 35 (explained later) when the tape cassette 35 is loaded in the cassette storage part 8, a mark sensor 12 (implemented by a reflective photosensor, for example) is provided. The reflective photosensor forming the mark sensor 12 includes a light emitting element and a photoreceptor element mounted on the same circuit board. The light emitting element irradiates the back side of a strippable sheet (facing the mark sensor 12) with light, and reflected light from the back side of the strippable sheet is received by the photoreceptor element, by which whether a position indication mark 39B being colored black (explained later, see FIG. 6) is facing the mark sensor 12 or not is detected. The detection of the position indication mark 39B is implemented by use of an ON/OFF signal outputted by the mark sensor 12.

In a part to the left of the tape drive roller spindle 14 and in the rear of the entrance to the label outlet hole 16, a fixed blade 13A is set up. Meanwhile, in a part (facing the fixed blade 13A) in front of the entrance to the label outlet hole 16, a movable blade 13B is supported to be movable back and forth. The movable blade 13B is driven backward and forward by a cutter motor 32 (implemented by a DC motor, for example) which will be explained later (see FIG. 4) via a proper driving mechanism. The movable blade 13B cuts a tape (label tape 36, etc.) which has been fed to a tape cutting position by the tape drive roller 53 and the tape feed roller 11 after the printing, in cooperation with the fixed blade 13A.

In the cassette storage part 8, tape type sensors S1, S2, S3, S4 and S5 implemented by push microswitches, etc. are provided. These sensors S1–S5 are provided to a part of the cassette storage part 8 that will face a tape identification part 40 of the tape cassette 35 (for identifying the type of the tape stored in the tape cassette 35, see FIG. 5) when the tape cassette 35 (explained later) is loaded in the cassette storage part 8. Each tape type sensor S1–S5 is implemented by a well-known mechanical switch including a plunger, microswitch, etc. Each tape type sensor S1–S5 detects whether or not the tape identification part 40 has a through hole that has been formed corresponding to the sensor. Thus, the type of the tape stored in the tape cassette 35 can be detected based on ON/OFF signals outputted by the sensors S1–S5.

In this embodiment, the plunger of each tape type sensor S1–S5 constantly protrudes from the bottom of the cassette storage part 8 and the microswitch stays OFF. When a through hole (explained later) of the tape identification part 40 is situated at a position facing a tape type sensor S1–S5, the plunger is not pressed down and the microswitch remains OFF, by which an OFF signal is outputted by the sensor. On the other hand, when no through hole (explained later) of the tape identification part 40 is situated at the position facing the tape type sensor S1–S5, the plunger is pressed down and the microswitch turns ON, by which an ON signal is outputted by the sensor.

The cassette storage part 8 can be opened and closed by opening/closing a storage cover which is rotatably supported by a rear part of the tape printing device 1. The tape cassette 35 is replaced when the cassette storage part 8 is in the open state.

The type of the tape is identified by "tape type", "tape width", etc. The tape types include "receptor tape" (in which the surface of the printed tape is covered with no protective film), "laminate tape" (in which the surface of the printed tape is covered with a protective film), "label tape" (in which a plurality of labels are temporarily stuck on the surface (front side) of the strippable sheet along its lengthwise direction), etc. The tape widths include "6 mm", "9 mm", "12 mm", "1118 mm", "24 mm", etc.

In this embodiment, when the "tape type" is "label tape" and the "tape width" is "24 mm", the signals outputted by the tape type sensors S1–S5 (the presence/absence of a sensor hole (through hole) corresponding to each tape type sensor S1–S5) are as follows (see FIG. 5): "S1" is "OFF signal, i.e., a sensor hole exists", "S2" is "OFF signal, i.e., a sensor hole exists", "S3" is "ON signal, i.e., no sensor hole", "S4" is "ON signal, i.e., no sensor hole", "S5" is "OFF signal, i.e., a sensor hole exists".

Also for other tape types, the relationship between the ON/OFF signal outputted by each tape type sensor S1–S5 and the presence/absence of the corresponding through hole formed in the tape identification part 40 is the same (ON signal when there is no sensor hole, OFF signal when there is a sensor hole) and thus repeated explanation thereof is omitted.

As shown in FIG. 3, along a left edge part of the front face of the thermal head 9 in a flat and vertical rectangular shape, a prescribed number (128 in this embodiment) of heating elements R1–Rn (n: prescribed number) are arranged in a line. To a right edge part of the front face of the thermal head 9, an end of a flexible cable F (which is connected to a connector (unshown) formed on the unshown control circuit board) is electrically connected by soldering, etc.

The thermal head 9 is fixed by adhesives, etc. on a left edge part of the front face of a radiator plate 9A (plated steel plate, stainless steel plate, etc.) substantially in a rectangular shape so that the alignment direction of the heating elements R1–Rn will be in parallel with the left edge of the radiator plate 9A. The upper right corner of the flexible cable F is fixed on the front face of the radiator plate 9A with a double-faced adhesive tape, etc. The other end of the flexible cable F is inserted into a through hole 9D (substantially in the shape of a long rectangle stretching horizontally, formed in a bottom part of the radiator plate 9A) and is led to the rear of the radiator plate 9A.

At the bottom of the radiator plate 9A, an extension part 9B substantially in a rectangular shape is formed to extend forward from the radiator plate 9A by a prescribed width. The extension part 9B is provided with two through holes 9C and 9C. The radiator plate 9A is attached on the bottom of the cassette storage part 8 by screws, etc. via the through holes 9C and 9C so that the alignment direction of the heating elements R1–Rn will be substantially orthogonal to the feeding direction of the label tape 36 (see FIG. 5) at an opening part 52 (see FIG. 5) of the tape cassette 35.

As shown in FIG. 4, the control system of the tape printing device 1 is built up around the control circuit unit 20 which is formed on the unshown control circuit board as the core. The control circuit unit 20 includes a CPU 21 which controls each component, an I/O (input-output) interface 23, a CGROM 24, ROMs 25 and 26, and a RAM 27, which are connected to the CPU 21 via a data bus 22. Incidentally, a timer 21A is provided in the CPU 21.

In the CGROM 24, dot patterns of a lot of characters are stored, being associated with corresponding code data.

In the ROM 25 (dot pattern data memory), print dot pattern data to be used for printing characters (alphabetical letters, symbols, etc.) are stored, being associated with corresponding code data of characters. The print dot pattern data associated with the code data are classified by font (Gothic font, Mincho font, etc.), and the print dot pattern data of each font includes data for six print character sizes (16, 24, 32, 48, 64 and 96 dots). The ROM 25 also stores graphic pattern data to be used for printing graphic images including gradation.

In the ROM 26, a variety of programs listed below are stored.

(1) display drive control program for controlling an LCDC 28 according to code data of characters (letters, numbers, etc.) inputted through the keyboard 6

(2) print drive control program for reading data from a print buffer 27B and thereby controlling the thermal head 9 and the tape feed motor 30

Figure 8:
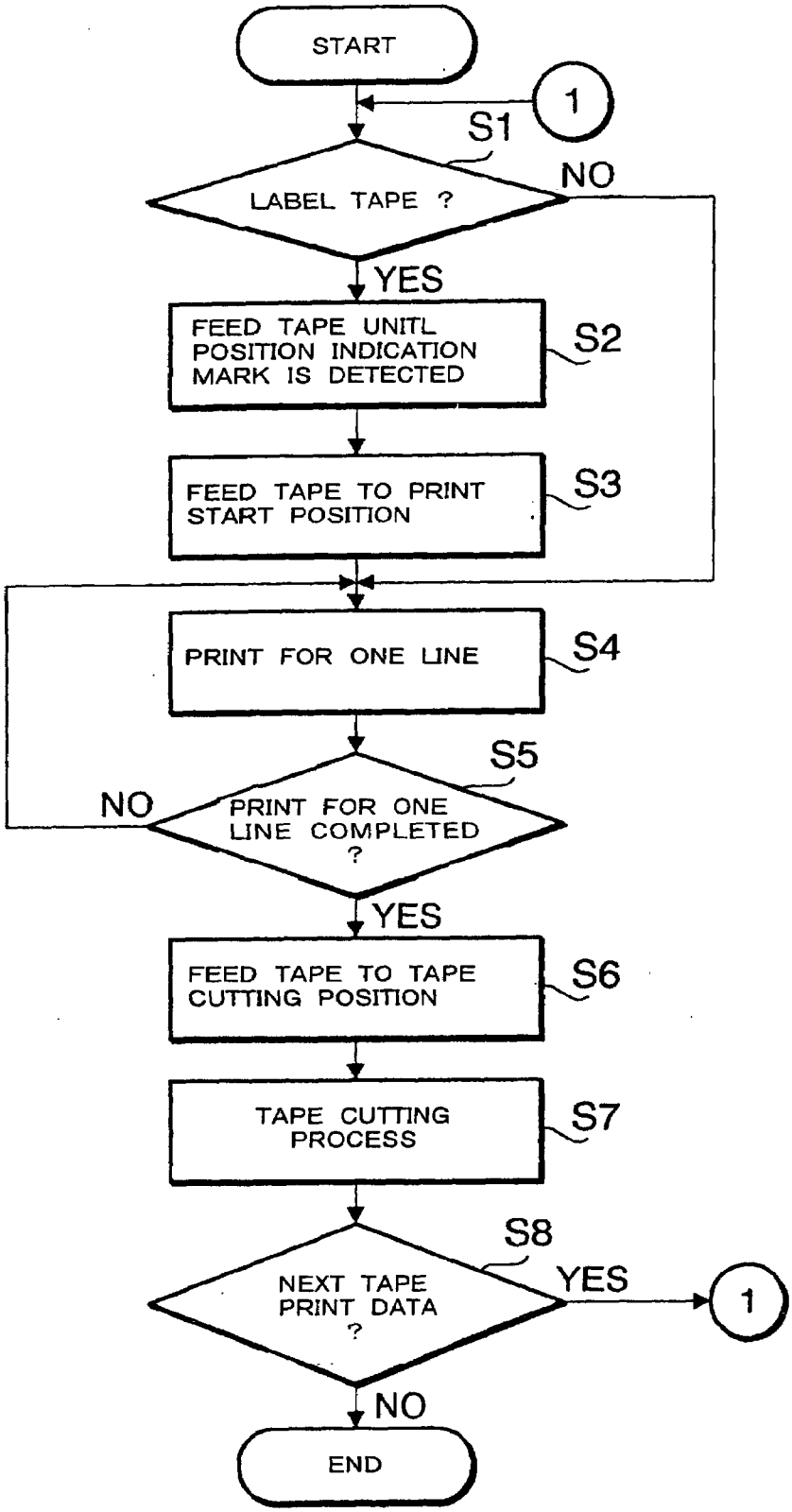
FIG. 8 is a flow chart showing a print control process carried out by the tape printing device in accordance with the embodiment.

(3) pulse number determination program for determining a pulse number corresponding to the amount of formation energy of each print dot (4) label tape feed control program for detecting the position indication mark formed on the back of the label tape 36 by the mark sensor 12 and thereby driving the tape feed motor 30 up to a print start position of each label (see FIG. 8)

(5) cutting drive control program for feeding the label tape 36 to a cutting position by driving the tape feed motor 30 and cutting the label tape 36 by driving the cutter motor 32 when printing is finished (see FIG. 8)

(6) various other programs necessary for the control of the tape printing device 1

The CPU 21 executes various calculations according to the programs stored in the ROM 26.

In the RAM 27, storage areas such as a text memory 27A, the print buffer 27B, a counter 27C, a total print dot number counter 27D and a parameter storage area 27E are formed. The text memory 27A stores document data inputted through the keyboard 6. The print buffer 27B stores print dot patterns of a plurality of letters, symbols, etc. and print pulse numbers (indicating the formation energy of each dot) as dot pattern data. The printing by the thermal head 9 is carried out according to the dot pattern data stored in the print buffer 27B. The counter 27C stores a count N of dots that have been printed by the thermal head 9 for a line (128 dots in this embodiment). The total print dot number counter 27D stores the total number of dots printed by the thermal head 9 since the startup. The parameter storage area 27E stores various calculation data.

Connected to the I/O interface 23 are the keyboard 6, the mark sensor 12, the tape type sensors S1–S5, the display controller 28 (LCDC 28) including a video RAM 28A for outputting display data to the liquid crystal display (LCD) 7, a drive circuit 29 for driving the thermal head 9, a drive circuit 31 for driving the tape feed motor 30, and a drive circuit 33 for driving the cutter motor 32.

By the above configuration, when letters, etc. are inputted through letter keys of the keyboard 6, the inputted text (document data) is successively stored in the text memory 27A, and a dot pattern corresponding to the letters, etc. inputted through the keyboard 6 is displayed on the LCD 7 by a dot pattern generation control program and the display drive control program. The CPU 21 drives the thermal head 9 through the drive circuit 29, by which the printing of the dot pattern data stored in the print buffer 27B is carried out. In sync with the printing operation, the tape feed motor 30 is driven by the drive circuit 31 and thereby the tape feed control is executed. The heating elements R1–Rn of the thermal head 9 (corresponding to a line of print dots) are selectively driven and heated by the drive circuit 29, by which the letters, etc. are printed on the tape.

In the following, a brief outline of the composition of the tape cassette 35 which is loaded in the tape printing device 1 of this embodiment will be described referring to FIGS. 5 and 6.

Figure 5:
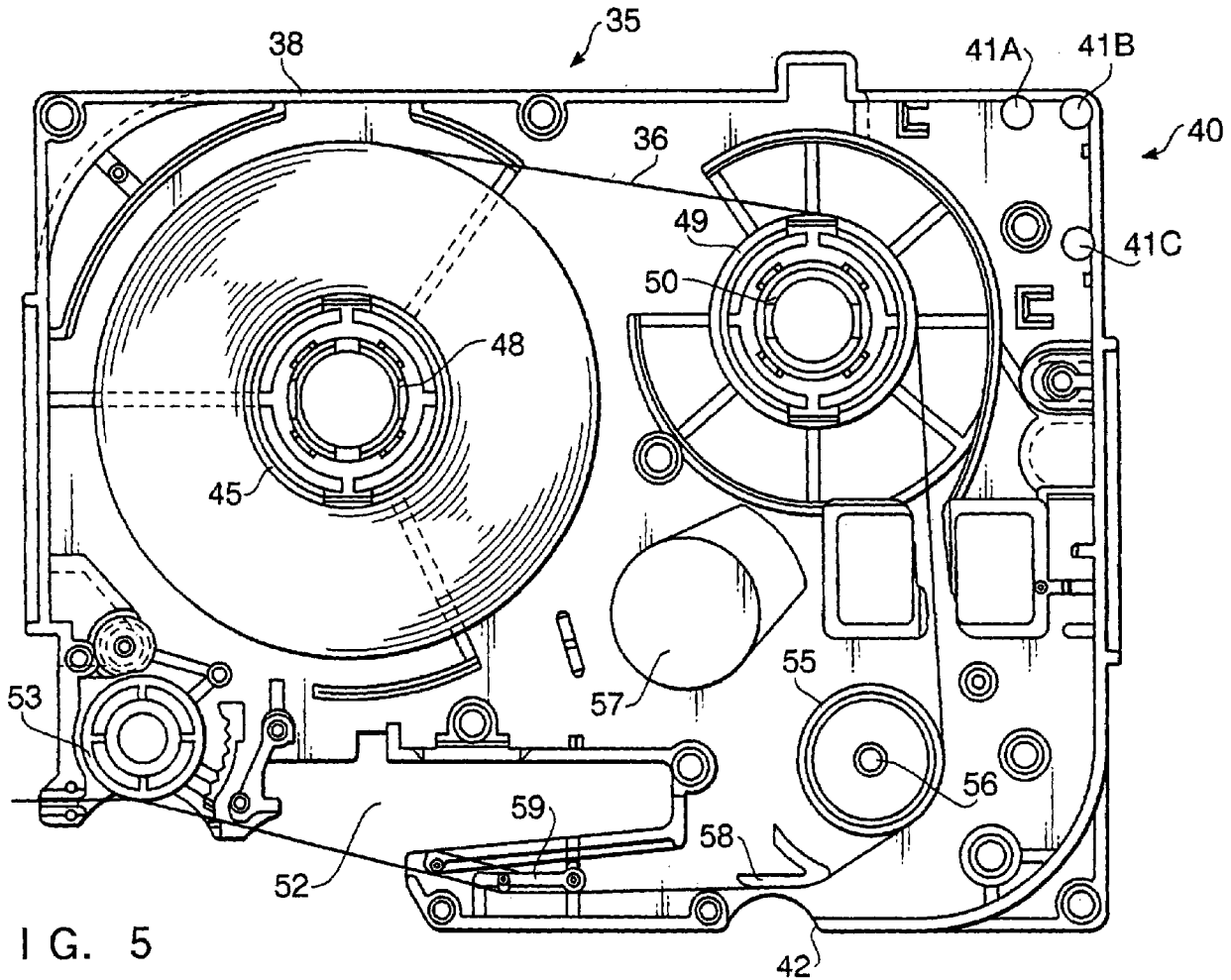
FIG. 5 is a plan view of a tape cassette to be loaded in the tape printing device of this embodiment with its cover removed.

FIG. 5 is a plan view of the tape cassette 35 to be loaded in the tape printing device 1 of this embodiment, with its cover removed. FIG. 6 is a side view of the tape cassette 35, showing a state in which the label tape 36 has been pulled out and the position indication mark for the second label is facing the mark detection opening 42.

Figure 6:
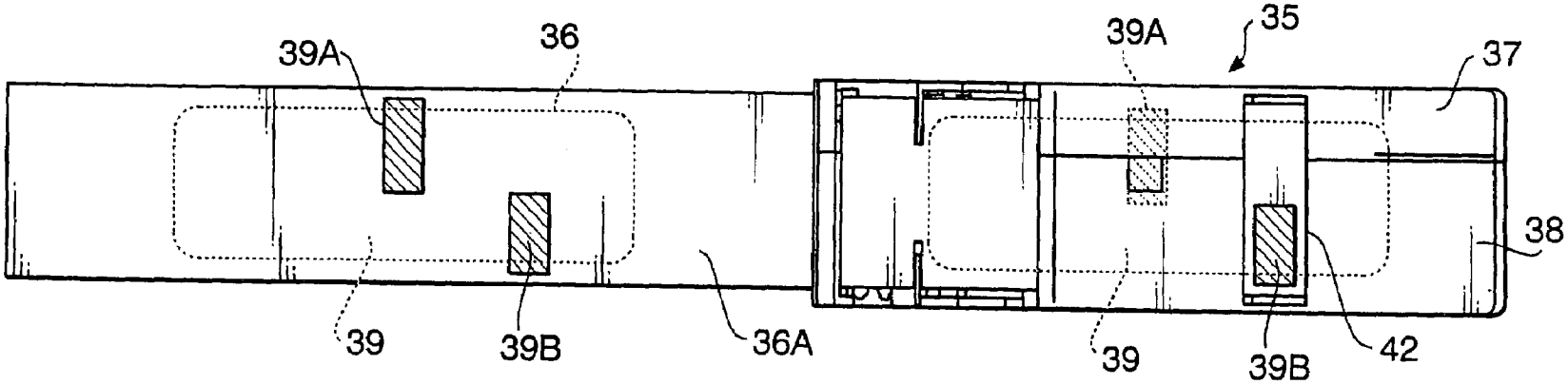
FIG. 6 is a side view of the tape cassette to be loaded in the tape printing device of this embodiment, showing a state in which a label tape has been pulled out and a position indication mark for a second label is facing a mark detection opening.

As shown in FIGS. 5 and 6, the tape cassette 35 of this embodiment includes a cover 37 covering the top of the tape cassette 35, a cassette body 38, and the label tape 36.

The label tape 36 includes a long strippable sheet 36A and a plurality of labels 39 (substantially in horizontal rectangular shapes) which are temporarily stuck on the surface of the strippable sheet 36A at preset intervals along the length of the strippable sheet 36A. On the back side of the strippable sheet 36A, a plurality of marks 39A are formed at positions substantially corresponding to the centers of the labels 39 in regard to the feeding direction. Each mark 39A is colored black substantially in a vertical rectangular shape stretching from almost the top of the back side of the strippable sheet 36A to a central part of the strippable sheet 36A in its width direction. Meanwhile, a plurality of position indication marks 39B are also formed on the back side of the strippable sheet 36A. Each position indication mark 39B for each label 39 is formed at a position substantially corresponding to the midpoint between the center of the label 39 in the feeding direction and an upstream edge of the label 39. Each position indication mark 39B is colored black substantially in a vertical rectangular shape stretching from almost the bottom of the back side of the strippable sheet 36A to a central part of the strippable sheet 36A in its width direction. The width of the position indication mark 39B measured in the feeding direction is substantially the same as the width of the mark sensor 12 measured in the feeding direction (horizontal direction in FIG. 2). The label tape 36 is rolled up around a tape spool 45 with the back side of the strippable sheet 36A, facing outward and is stored in the tape cassette 35. Each label 39 (including a base tape, a thermosensitive coloring layer formed on a side of the base tape, and an adhesive layer formed on the other side of the base tape) is stuck on the surface of the strippable sheet 36A via the adhesive layer.

Through a lateral part of the tape cassette 35 facing the mark sensor 12 when the tape cassette 35 is loaded in the cassette storage part 8, the mark detection opening 42 is formed substantially in a vertical rectangular shape with a height (in the vertical direction) almost the same as that of the tape cassette 35 and a width (in the feeding direction) slightly larger than that of the position indication mark 39B. By this configuration, when the tape cassette 35 is loaded in the cassette storage part 8, the position indication marks 39B formed on the back side of the label tape 36 can be detected by the mark sensor 12 through the mark detection. opening 42 while the label tape 36 is fed in the feeding direction.

As shown in FIG. 5, the tape spool 45 is stored in the cassette body 38, being rotatably engaged with a cassette boss 48 which is vertically formed on the bottom of the cassette body 38. To the right of the cassette boss 48, a guide spool 49 substantially in a cylindrical shape is rotatably engaged with a cassette boss 50 which is vertically formed on the bottom of the cassette body 38. On the downstream side of the cassette boss 50, a reel 55 substantially in a cylindrical shape is rotatably engaged with a reel boss 56 which is vertically formed on the bottom of the cassette body 38. Through a bottom part of the cassette body 38 facing the ink ribbon roll-up spindle 15 when the tape cassette 35 is loaded in the cassette storage part 8, a through hole 57 having a diameter larger than that of the ink ribbon roll-up spindle 15 is formed.

The label tape 36 pulled out from the tape spool 45 is guided to the opening part 52 to which the thermal head 9 is inserted, via the guide spool 49, the reel 55 and guide members 58 and 59 vertically formed on the bottom of the cassette body 38. Thereafter, the label tape 36 passes between the thermal head 9 and the platen roller 10. In a downstream part of the cassette body 38 (lower left part in FIG. 5), the tape drive roller 53 is provided so as to be driven and rotated by the tape drive roller spindle 14. After passing between the tape drive roller 53 and the tape feed roller 11 (facing the roller 53), the label tape 36 is fed to the outside of the tape cassette 35 and then reaches the label outlet hole 16 of the tape printing device 1. The label tape 36 which has been fed to the cutting position is cut by the fixed blade 13A and the movable blade 13B and is ejected through the label outlet hole 16.

In a corner part of the bottom of the cassette body 38 (upper right part in FIG. 5) facing the tape type sensors S1–S5 when the tape cassette 35 is loaded in the cassette storage part 8, the tape identification part 40 having through holes 41A, 41B and 41C is provided. The through holes 41A, 41B and 41C are formed at positions facing the tape type sensors S1, S2 and S5, respectively. By this configuration, OFF signals are outputted by the tape type sensors S1, S2 and S5 while ON signals are outputted by the tape type sensors S3 and S4, by which the type of the print tape stored in the tape cassette 35 is identified as a prescribed label tape 36 having a tape width of 24 mm.

In the following, positional relationship between a next label 39 (which will be printed on next) and each part of the tape printing device 1, at the point when printing on a label 39 of the label tape 36 has been finished and the label tape 36 has been fed to the tape cutting position to be cut by the fixed blade 13A and the movable blade 13B, will be explained referring to FIG. 7. Specifically, FIG. 7 depicts positional relationships among the next label 39, a position indication mark 39B opposed to (i.e. facing via the strippable sheet) the next label 39, the heating elements R1–Rn, and the mark sensor 12.

Figure 7:
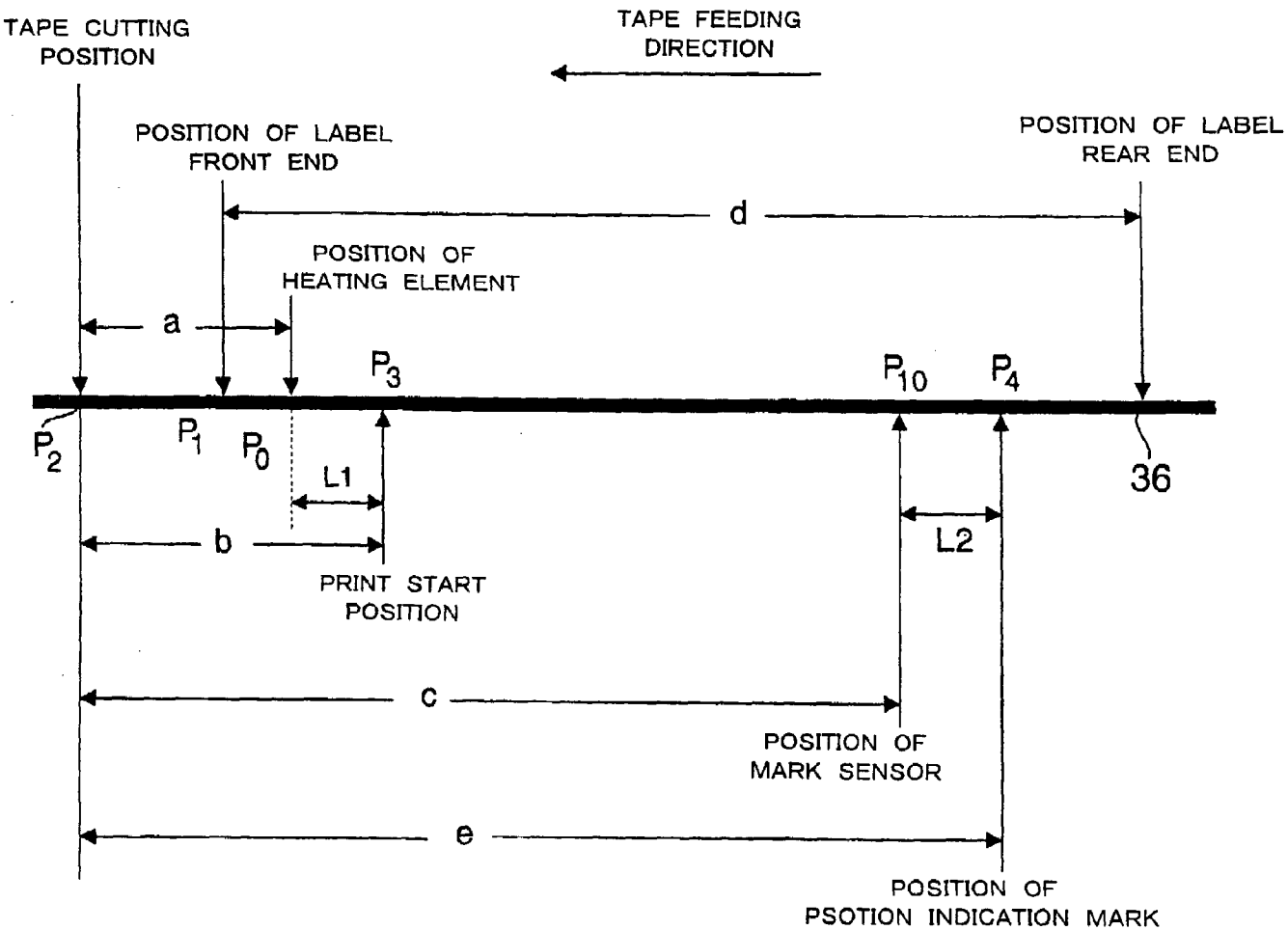
FIG. 7 is a schematic horizontal sectional view schematically showing positional relationships among a next label (which will be printed on next), a position indication mark opposed to the next label, heating elements and a mark sensor, at the point when the tape cassette has been loaded in the tape printing device in accordance with the embodiment, printing on a label of the label tape has been finished, and the label tape has been fed to a tape cutting position.

In FIG. 7, $P_0$ denotes the position of the heating elements R1–Rn of the thermal head 9 at the point when printing on a label 39 of the label tape 36 has been finished and the label tape 36 has been fed to the tape cutting position $P_2$ to be cut by the fixed blade 13A and the movable blade 13B. The position $P_0$ is slightly on the upstream side of a label front end position $P_1$ of the next label 39 (an end on the downstream side in the feeding direction) and on the downstream side of a print start position $P_3$ of the next label 39 (that is, a<b in FIG. 7).

$P_{10}$ in FIG. 7 denotes the position of the mark sensor 12. The mark sensor 12 is situated on the upstream side of the heating elements R1–Rn and slightly on the downstream side of the position $P_4$ of the position indication mark 39B (that is, c<e in FIG. 7).

The distance from the position $P_0$ of the heating elements (at the point when printing on a label 39 of the label tape 36 has been finished and the label tape 36 has been fed to the tape cutting position to be cut by the fixed blade 13A and the movable blade 13B) to the print start position $P_3$ of the next label 39 measured in the feeding direction is assumed to be L1 (L1=b−a in FIG. 7), and the distance from the position $P_{10}$ of the mark sensor 12 to the position $P_4$ of the position indication mark 39B measured in the feeding direction is assumed to be L2 (L2=e−c in FIG. 7). In this case, the heating elements R1–Rn and the mark sensor 12 are situated so that L1≧L2 will be satisfied.

By this configuration, after detecting a position indication mark 39B on the label tape 36 by the mark sensor 12, the print start position of the label 39 corresponding to the position indication mark 39B can surely be conveyed to the position facing the heating elements R1–Rn.

In the following, a print control process executed by the tape printing device 1 configured as above will be described referring to FIG. 8.

FIG. 8 is a flow chart showing the print control process carried out by the tape printing device 1 in accordance with this embodiment.

As shown in FIG. 8, in step (hereinafter abbreviated as "S") 1, the CPU 21 executes a judgment process for judging whether a tape stored in a tape cassette loaded in the cassette storage part 8 is a label tape or not by use of tape type sensors S1–S5.

If the tape cassette loaded in the cassette storage part 8 is judged to be a tape cassette 35 storing a label tape 36 (S1: YES), the CPU 21 carries out S2. In S2, when the print key 3 on the keyboard 6 is pressed, the CPU 21 feeds the label tape 36 (by rotating the tape drive roller 53 and the tape feed roller 11 by driving the tape feed motor 30) until a position indication mark 39B is detected by the mark sensor 12.

Subsequently, in S3, the CPU 21 feeds the label tape 36 to the print start position of the label 39 based on print data which has been inputted through the character input keys 2 and stored in the print buffer 27B of the RAM 27. This feeding is carried out by rotating the tape drive roller 53 and the tape feed roller 11 by further driving the tape feed motor 30.

In S4, with the heating elements R1–Rn of the thermal head 9 facing the print start position of the label 39, the CPU 21 lets the heating elements R1–Rn print part of the letters, etc. stored in the print buffer 27B for a line (corresponding to a line of heating elements R1–Rn) on the label 39.

Subsequently, in S5, the CPU 21 executes a judgment process for judging whether or not all the letters, etc. for one label stored in the print buffer 27B have already been printed out.

If the printing of all the letters, etc. for one label stored in the print buffer 27B of the RAM 27 has not been completed yet (S5: NO), the CPU 21 lets the heating elements R1–Rn print part of the letters, etc. for the next line on the label 39 while feeding the label tape 36 by the tape drive roller 53.

On the other hand, if all the letters, etc. stored in the print buffer 27B of the RAM 27 have already been printed out (S5: YES), the CPU 21 in S6 feeds the label tape 36 to the tape cutting position by properly rotating the tape drive roller 53 by driving and rotating the tape feed motor 30 by a prescribed angle.

Subsequently, in S7, the CPU 21 moves the movable blade 13B forward by driving the cutter motor 32, by which the label tape 36 is cut by the movable blade 13B and the fixed blade 13A.

Thereafter, in S8, the CPU 21 executes a judgment process for judging whether or not print data of letters, etc. to be printed on the next label 39 have been stored in the print buffer 27B. If the print data of letters, etc. for the next label have been stored in the print buffer 27B (S8: YES), the CPU 21 carries out the process from S1 again.

On the other hand, if the print buffer 27B has not stored the print data of letters, etc. to be printed on the next label (S8: NO), the CPU 21 ends the process.

By the above process, the letters, etc. stored in the print buffer 27B can be printed on each label 39 of the label tape 36.

In S1, if the tape cassette loaded in the cassette storage part 8 is judged not to be a tape cassette 35 storing a label tape 36 but to be an ordinary print tape (S1: NO), the CPU 21 carries out the process from S4.

By the process, the letters, etc. stored in the print buffer 27B can be printed on an ordinary print tape that is not a label tape 36.

As explained above in detail, in the tape printing device 1 in accordance with the embodiment of the present invention, at the point when the printing on a label 39 of the label tape 36 has been finished and the label tape 36 has been fed to the tape cutting position, the position ($P_0$) of the heating elements R1–Rn is slightly on the upstream side of the label front end position ($P_1$) of the next label 39 (an end on the downstream side in the feeding direction) and on the downstream side of the print start position ($P_3$) of the next label 39 (that is, a<b in FIG. 7). Meanwhile, the mark sensor 12 is situated on the upstream side of the heating elements R1–Rn and slightly on the downstream side of the position ($P_4$) of the position indication mark 39B (that is, c<e in FIG. 7). At the point when the printing on the label 39 of the label tape 36 has been finished and the label tape 36 has been fed to the tape cutting position to be cut by the fixed blade 13A and the movable blade 13B, the heating elements R1–Rn and the mark sensor 12 are situated so that the distance L1 from the position ($P_0$) of the heating elements to the print start position ($P_3$) of the next label 39 measured in the feeding direction (L1=b−a in FIG. 7) will be longer than or equal to the distance L2 from the position ($P_{10}$) of the mark sensor 12 to the position ($P_4$) of the position indication mark 39B measured in the feeding direction (L2=e−c in FIG. 7), that is, L1≧L2.

In the case where the tape stored in the tape cassette 35 is identified by the tape type sensors S1–S5 as a prescribed label tape 36, the label tape 36 is fed forward by driving the tape feed motor 30 and the position indication mark 39B formed on the back side of the label tape 36 is detected by the mark sensor 12 (S1–S2). Subsequently, the print start position of the label 39 is placed to face the heating elements R1–Rn of the thermal head 9 by driving the tape feed motor 30 by a prescribed number of steps and then the letters, etc. stored in the print buffer 27B are printed on the label 39 while driving the tape feed motor 30 in sync with the printing (S3-S5: NO). When the printing on the label 39 is finished, the CPU 21 feeds the label tape 36 to the tape cutting position by driving and rotating the tape feed motor 30 by a prescribed angle and then cuts the label tape 36 by the movable blade 13B by driving the cutter motor 32, by which part of the label tape 36 which has been cut off is ejected from the label outlet hole 16 (S5: YES—S8: NO).

Since the heating elements R1–Rn of the thermal head 9 are placed at the position on the downstream side of the print start position of the next label 39 at the point when the label tape 36 after the printing on the previous label 39 has been fed to the tape cutting position to be cut by the fixed blade 13A and the movable blade 13B, even when the next label 39 is the last label 39 of the label tape 36, the printing can be carried out by the heating elements R1–Rn surely from the print start position of the label 39. Further, at the point when the label tape 36 after the printing on the previous label 39 has been fed to the tape cutting position of the fixed blade 13A and the movable blade 13B, the mark sensor 12 is situated at the position on the downstream side of the position indication mark 39B opposed to the next label 39 and on the upstream side of the heating elements R1–Rn. Therefore, even if the power is shut down after the cutting of the label tape 36, the position indication mark 39B of the first label 39 can surely be detected by the mark sensor 12 on the restart of the tape printing device 1 and the label tape 36 can correctly be fed to the print start position of the first label 39 based on the output signal of the mark sensor 12.

Since the position indication mark 39B can be placed as close as possible to a position facing the mark sensor 12 at the point when the label tape 36 after the printing on a label 39 has been fed to the tape cutting position, feeding distance of the label tape 36 necessary for the detection of the position indication mark 39B can be set short and the space (interval) between adjacent labels 39 can be reduced.

Since each label tape 36 has been rolled up in a tape cassette 35 which is detachably loaded in the tape printing device 1, the loading, replacement, etc. of the label tape 36 can be done with ease.

Since the label tape 36 is surely fed to the print start position of each label 39 in the case where the tape cassette 35 is identified by the tape type sensors S1–S5 to contain the label tape 36, the printing on the labels 39 can be carried out correctly even when a variety of tape cassettes are used. Incidentally, in the case where a tape cassette storing a tape that is not a label tape 36 is loaded in the tape printing device 1, the tape feeding is carried out not based on the output signal of the mark sensor 12, therefore, the letters, etc. can certainly be printed on the intended tape.

By loading the tape cassette 35 in the tape printing device 1, the printing on each label 39 can be carried out by the heating elements R1–Rn while feeding the label tape 36 in the opening part 52, as well as surely feeding the label tape 36 to the print start position of each label 39 by the detection of the position indication mark 39B of each label 39 by the mark sensor 12 through the mark detection opening 42.

Further, in cases where a printable front end position of the label 39 is a downstream edge part of the label 39 (an edge part of the label 39 on its downstream side) in regard to the feeding direction, feeding distance of the label tape 36 to the print start position of the label 39 after the detection of the position indication mark 39B by the mark sensor 12 can be set short and the space (interval) between adjacent labels 39 can be reduced.

In the above embodiment, each position indication mark 39B is formed at a position on the downstream side (in the feeding direction) of a position on the back side of the strippable sheet opposed to a rear end position of each label. Therefore, the position indication mark 39B can be placed as close as possible to the position facing the mark sensor 12 at the point when the label tape after the printing on a label has been fed to the tape cutting position to be cut by the cutter member, by which the feeding distance of the label tape necessary for the detection of the position indication mark 39B can be set short and the space (interval) between adjacent labels can be reduced further.

In the tape cassette 35 described in the above embodiment, by configuring the tape cassette 35 so that the printable front end position of the label will be exposed to the opening part 52 when the position indication mark 39B is situated at the mark detection opening 42, the label tape can correctly be fed to the print start position of the label by the detection of the position indication mark 39B by the mark sensor 12.

Incidentally, it is to be appreciated that the present invention is not to be restricted by the particular illustrative embodiment described above and a variety of improvements, modifications, etc. are possible without departing from the scope and spirit of the present invention. For example, the following configurations are also possible.

(a) While the position indication marks 39B are detected by a mark sensor 12 in the above embodiment, it is also possible to arrange two mark sensors 12 vertically and let the upper mark sensor 12 detect the marks 39A while letting the lower mark sensor 12 detect the position indication marks 39B. By this configuration, the feeding control of the label tape 36 can be executed based on both output signals regarding the marks 39A and the position indication marks 39B in cases of successive printing on a plurality of labels 39.

(b) While each position indication mark 39B in the above embodiment is formed as a black mark substantially in a vertical rectangular shape, it is also possible to configure the position indication mark 39B as a magnetic mark substantially in a vertical rectangular shape and implement the mark sensor 12 by a magnetic sensor. By this configuration, the mark sensor 12 can be miniaturized.

(c) While the heating elements R1–Rn in the above embodiment are placed so that they will be situated slightly on the print-start-position side of the front end position of the next label 39 (which will be printed on next) at the point when the label tape 36 has been fed to the tape cutting position, the heating elements R1–Rn may also be placed so that they will be situated at a position substantially corresponding to the front end position of the next label 39 or at a position in the vicinity of the front end position on the upstream side or downstream side of the front end position in the feeding direction. By this configuration, after the position indication mark 39B is detected by the mark sensor 12, the print start position of the label 39 (opposed to the position indication mark 39B) can be fed by the feeding control to the position facing the heating elements R1–Rn more correctly.

Incidentally, the above embodiments have been described as illustrations and thus the present invention is not to be restricted by the contents of the embodiments but to be understood according to the contents of the appended claims.

The invention claimed is:

1. A tape printing device comprising a tape feed unit for feeding a long tape, a printing unit for printing on the tape, and a cutter member being placed on the downstream side of the printing unit for cutting the tape, the tape being formed of a label tape in which a plurality of labels are temporarily stuck on a front side of a long strippable sheet being aligned along the length of the strippable sheet, the tape printing device further comprising:

a mark sensor which detects position indication marks formed at prescribed positions in a tape feeding direction on a back side of the strippable sheet opposed to corresponding labels respectively; and a control unit which controls the tape feed unit based on a output signal outputted by the mark sensor, the printing unit including a plurality of printing elements, the printing elements being situated on the downstream side of a print start position of a next label which will be printed on next at a point when the label tape after the printing on a label has been fed to a tape cutting position to be cut by the cutter member, the mark sensor being situated on the downstream side of a position indication mark opposed to the next label and on the upstream side of the printing elements at the point when the label tape after the printing on a label has been fed to the tape cutting position to be cut by the cutter member.

2. The tape printing device according to claim 1, wherein each position indication mark is formed at a position on the downstream side in the feeding direction of a position on the back side of the strippable sheet opposed to a rear end position of each label.

3. The tape printing device according to claim 1, wherein the tape has been rolled up in a tape cassette which is detachably loaded in the tape printing device.

4. The tape printing device according to claim 3, further comprising a tape type detecting unit which detects the type of the tape rolled up in the tape cassette, wherein when the tape is identified by the tape type detecting unit as a label tape, the control unit controls the tape feed unit to feed the label tape to the print start position of each label based on the output signal outputted by the mark sensor.

5. A tape printing device for printing on a long tape, the long tape is a label tape including:

a plurality of labels temporarily stuck on a front side of a long strippable sheet being aligned along the length of the strippable sheet; and a plurality of position indication marks formed on a back side of the strippable sheet along the length of the strippable sheet to be opposed to corresponding labels respectively for enabling detection of each label on the front side, each position indication mark corresponding to each label on the front side being formed at a position on the back side of the strippable sheet that corresponds to a prescribed position on the corresponding label in a tape feeding direction, the tape printing device comprising:

a tape feed unit for feeding the long tape;

a printing unit for printing on the tape;

a cutter member being placed on the downstream side of the printing unit in the tape feeding direction for cutting the tape;

a mark sensor which successively detects the position indication marks formed on the long tape when the tape is fed; and a control unit which carries out printing by controlling the printing unit while controlling the tape feed unit based on an output signal outputted by the mark sensor, the printing unit being placed so that the printing unit, at a point when the label tape after the printing on a label has been fed by the control unit to a tape cutting position to be cut by the cutter member, will be situated on the downstream side in the feeding direction of a print start position of a label nearest to the tape cutting position, the mark sensor being placed so that the mark sensor, at the point when the label tape after the printing on a label has been fed by the control unit to the tape cutting position to be cut by the cutter member, will be situated on the downstream side in the feeding direction of a position indication mark corresponding to the label nearest to the tape cutting position and on the upstream side in the feeding direction of the printing unit.

6. The tape printing device according to claim 5, wherein the printing unit is placed so that the printing unit, at the point when the label tape after the printing on a label has been fed by the control unit to the tape cutting position to be cut by the cutter member, will be situated on the downstream side in the feeding direction of the print start position of the label nearest to the tape cutting position and on the upstream side in the feeding direction of a label front end position of the label nearest to the tape cutting position.

7. The tape printing device according to claim 5, wherein a distance L1 from a position of the printing unit to the print start position of the label nearest to the tape cutting position measured in the tape feeding direction and a distance L2 from a position of the mark sensor to a position of the position indication mark corresponding to the label nearest to the tape cutting position measured in the tape feeding direction at the point when the label tape after the printing on a label has been fed by the control unit to the tape cutting position to be cut by the cutter member satisfy a relationship $L1 \geqq L2$.

8. The tape printing device according to claim 5, wherein on starting the printing on a label, the control unit first searches for the position indication mark by the mark sensor, places the printing unit at a position corresponding to the print start position by feeding the tape by a prescribed distance by the tape feed unit when the position indication mark is detected, and then starts the printing by the printing unit.

* * * * *